US006090765A

United States Patent [19]

Black et al.

[11] Patent Number: 6,090,765

[45] Date of Patent: Jul. 18, 2000

[54] COMPOSITION FOR CLEANING HARD SURFACES

[75] Inventors: Robert H. Black; John F. Dorrian, both of Jacksonville; J. Christopher Shannon, Ponte Vedra Beach, all of Fla.

[73] Assignee: Church & Dwight Co., Inc., Princeton, N.J.

[21] Appl. No.: 09/209,258

[22] Filed: Dec. 10, 1998

Related U.S. Application Data

[60] Provisional application No. 60/069,395, Dec. 12, 1997, and provisional application No. 60/095,456, Aug. 6, 1998.

[51] Int. Cl.[7] ..... C11D 1/08

[52] U.S. Cl. ..... 510/238; 510/181; 510/182; 510/214; 510/365; 134/26

[58] Field of Search ..... 510/181, 182, 510/214, 238, 239, 243, 244, 245, 254, 365, 421–428, 432, 433, 466, 500; 134/26

[56] References Cited

U.S. PATENT DOCUMENTS

| | | | |
|---|---|---|---|
| 4,247,408 | 1/1981 | Imamura et al. . | |
| 5,409,639 | 4/1995 | Fusiak et al. | 252/542 |
| 5,503,778 | 4/1996 | Liu et al. | 252/542 |
| 5,789,363 | 8/1998 | Cala et al. | 510/245 |
| 5,837,664 | 11/1998 | Black | 510/238 |

FOREIGN PATENT DOCUMENTS 9602624 7/1995 WIPO .

*Primary Examiner*—Yogendra Gupta
*Assistant Examiner*—Dawn L. Garrett
*Attorney, Agent, or Firm*—Browdy and Neimark

[57] ABSTRACT

The invention relates to an aqueous hard surface cleaner composition containing a synergistic combination of a surface tension reducing agent, a superwetting agent and an organic coupling/degreasing agent that targets each of the interfaces present when the cleaner is in contact with soil deposit on a hard surface to provide effective cleaning properties with a low concentration of active ingredients.

8 Claims, 1 Drawing Sheet

COMPOSITION FOR CLEANING HARD SURFACES

CROSS-REFERENCE TO RELATED APPLICATIONS

The present application claims priority under 35 USC §119(e) from U.S. provisional application Ser. Nos. 60/069,395, filed Dec. 12, 1997, and 60/095,456, filed Aug. 6, 1998, the entire contents of both are hereby incorporated by reference.

BACKGROUND OF THE INVENTION

1. Field of Invention

The invention relates to a composition for cleaning hard surfaces, such as those of glass, counter tops, appliances, metals and the like.

2. Description of the Related Art

Commercially available hard surface cleaners are water-based blends of surfactants and non-aqueous solvents in which the loading of surfactant must be high enough to wet greasy surfaces and the loading of solvent must also be high enough to retain the soils on the surface in suspension until these soils are wiped off in the cleaning process. These commercially available hard surface cleaner compositions typically contain more than 1% surfactant and more than 2% non-aqueous solvent(s), where a compromise is generally reached between providing sufficient amounts of surfactant to be an effective cleaner and having a low enough amount of surfactant so as to not leave an undesirable residual film on the surface. The amount of solvent is generally also a compromise. Whereas less polar solvents wet surfaces better but require high loading to retain soils, more polar solvents have decreased effectiveness as wetting agents but require less loading to retain soils.

SUMMARY OF THE INVENTION

The present invention provides an aqueous composition for cleaning hard surfaces, such as those of glass, counter tops, appliances, metals, and the like, which contains a blend of surface active agents and coupling/degreasing agents that act synergistically to reduce the amount of surfactants and organic solvents needed in the present cleaner composition, compared to conventional cleaners, in order to be effective for its intended purpose. The synergistic blend in the present aqueous composition includes a surface tension reducing agent, a superwetting agent, and organic coupling and/or degreasing agents. In addition, an emulsifier can be included in the aqueous hard surface cleaner composition to increase the soil carrying capacity of the aqueous cleaner composition.

DETAILED DESCRIPTION OF THE INVENTION

Figure 1:
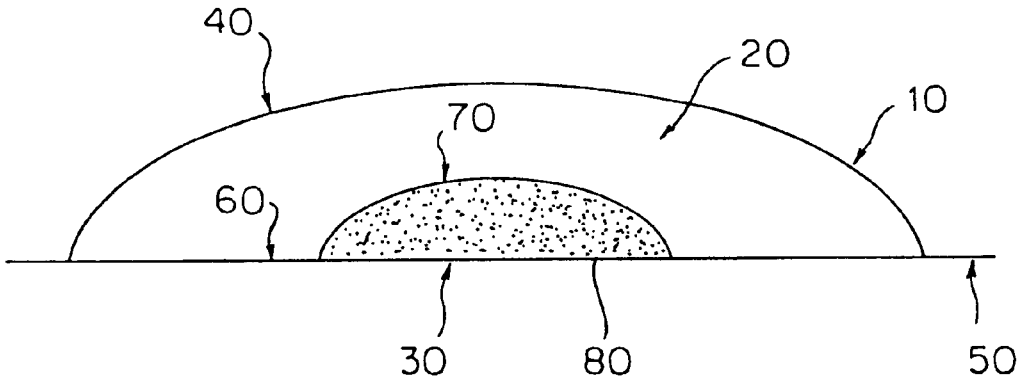
FIG. 1 is a schematic illustration of the interfaces that develop when an aqueous cleaner composition is in contact with a soil deposit on the surface of a solid substrate.

The aqueous hard surface cleaner composition according to the present invention contains a synergistic blend of surface active agents and coupling/degreasing agents which reduce the amount of surfactants as well as organic solvents needed in the present cleaner composition for effective cleaning. By combining small amounts of a superwetting agent and a surface tension reducing agent with one or more organic coupling/degreasing agents together into an aqueous composition, the present inventors discovered that such a blend provides a synergistic effect on surface spreading, soil penetration and soil loosening/lifting.

Each of the three active synergistic components of superwetting agent, surface tension reducing agent and organic coupling/degreasing agent in the present aqueous cleaner composition act at a different interface formed by contact of the aqueous cleaner composition with a soil deposit on a solid substrate surface. As shown in FIG. 1, the three interfaces synergistically acted upon by the aqueous cleaner composition according to the present invention are the cleaner/air interface 10 (between the air 40 and the aqueous cleaner composition 20 when applied to the soil deposit 80 on solid substrate 50), the cleaner/substrate interface 60, and the cleaner/soil interface 70. At the cleaner/air interface 10, where the surface tension reducing agent would be in a lower Gibb's free energy state than in the bulk of the aqueous cleaner composition or at the other interfaces, the surface tension reducing agent drives toward such a lower Gibb's free energy state and acts to facilitate spreading of the aqueous cleaner composition. Similarly, at the cleaner/substrate interface 60, the superwetting agent component of the present aqueous cleaner composition is at its lowest Gibb's free energy state where the superwetting agent interacts with the substrate surface to advantageously produce a hydrophilic surface. The organic coupling/degreasing agents also finds a lower Gibb's free energy state at the cleaner/soil interface 70 than in the bulk of the cleaner composition or at any other interface. By the synergistic actions of these active components of the present aqueous cleaner composition, the soil deposit is efficiently loosened and lifted from the solid substrate surface for retention in the bulk cleaner phase.

The surface tension reducing agent component of the aqueous cleaner composition of the present invention was found to be effective in the range of about 0.02 to 0.2% by weight of the aqueous composition, preferably in the range of about 0.02 to 0.06% by weight, and more preferably in the range of 0.03 to 0.05% by weight. Suitable surface tension reducing agents include, but are not limited to, linear aliphatic pyrrolidone surfactants (e.g., SURFADONE LP-100, commercially available from ISP, Wayne, N.J.), alkoxylated sulfonated surfactants (e.g., RHODAPEX CD 128, commercially available from Rhodia, Cranbury, N.J.), aliphatic (less than $C_{10}$) sulfonated surfactants (.e.g, GEROPON SS-0-75, commercially available from Rhodia), acetylenic diols (e.g., SURFYNOL 61, commercially available from Air Products, Allentown, Pa.), fluorinated surfactants (e.g., FLUORAD fluorochemical surfactant commercially available from 3M Corp., St. Paul, Minn.), and low hydrophilic-lipophilic balance (HLB) silicones (e.g., SW-E-18I, commercially available from Lambent Technologies, Norcross, Ga.). For obtaining a good synergistic cleaning effect in the aqueous cleaner composition according to the present invention, the preferred surface tension reducing agent is N-(n-octyl)-2-pyrrolidone.

The superwetting agent component of the aqueous cleaner composition of the present invention was found to be effective in the range of about 0.01 to 0.1% by weight of the aqueous composition, preferably in the range of about 0.01 to 0.05% by weight, and more preferably in the range of about 0.03 to 0.04% by weight. Suitable superwetting agents include, but are not limited to, di/tri siloxane glycol ethers (e.g., Q2-5211, commercially available from Dow Corning, Midland, Mich.), amine glycol ether of the form $H_2N$—

$(CH_2)_x$—$(OCH_2CH_2)_y$—OH, where x=2–4, and y=4–10, acetylenic diols with a low volatile organic content (VOC) of less than 5%, and more preferably less than 2%, as determined by the EPA method 24 (e.g., DYNOL 604, commercially available from Air Products), and di/tri siloxane glycerol polymers and amine glycerol polymers with a glycerol-based hydrophilic head. The preferred superwetting agent in the aqueous cleaner composition according to the present invention is a trisiloxane glycol ether surfactant, such as Q2-5211, or an acetylenic diol with low VOC, such as DYNOL 64.

Coupling agents are agents that act as a co-solvent with the aqueous phase of the cleaner composition, and degreasing agents are surfactants which retain soils by forming micelles. The organic coupling/degreasing agent is present, as a component of the synergistic blend in the aqueous cleaner composition according to the present invention, in the range of about 0.75 to 3.0% by weight, and is selected based on the soils to be cleaned. For window cleaning in densely populated areas and for cleaning grease in a kitchen, a mixture of three coupling/degreasing agents, dipropylene glycol methyl ether, N-methyl pyrrolidone and dipropylene glycol n-propyl ether, in equal proportion was found to be effective and is, accordingly, a preferred mixture. With only 0.75% by weight of a coupling/degreasing agent or a mixture of coupling/degreasing agents, the cleaning properties of the coupling/degreasing agent(s) are adequate for cleaning surfaces of glass and household appliances.

Less polar solvents, such as glycol ethers, wet surfaces better than more polar solvents but generally require a higher loading in the aqueous cleaner composition to retain soils. Conversely, while more polar solvents decrease the effectiveness of the superwetting agent in the composition, they have the property of being better able to retain soils. When an organic coupling/degreasing agent of low polarity, such as a glycol ether, is used in the aqueous cleaner composition according to the present invention, the loading of glycol ether can be increased or additional glycol ethers or a more polar solvent, e.g., dimethyl succinate propylene glycol methyl ether acetate, can be added to increase the grease cutting and soil carrying capacity for handling heavy soil deposits.

Suitable organic coupling/degreasing agents include, but are not limited to, short-chain pyrrolidones (e.g., N-methyl pyrrolidone, commercially available from ISP), dibasic esters (e.g., dimethyl succinate, commercially available from Solutia, St. Louis, Mo.), glycol ethers (e.g., dipropylene glycol n-propyl ether, commercially available from ARCO Chemical, Newtown Square, Pa.), oxygenated turpenes (e.g., α-turpineol), acetate solvents (e.g., ARCOSOLV PM acetate, commercially available from ARCO Chemical), alcohol solvents (e.g., α-butoxyethanol), lactone solvents (e.g, γ-butyrolactone), formamides (e.g., dimethylformamide), and sulfoxide solvents (e.g., dimethylsulfoxide).

Optionally, an emulsion-forming surfactant can be added to the aqueous cleaner composition to increase the soil-carrying capacity of the cleaner composition. Emulsifiers are well known in the art, and suitable emulsifiers are conventional emulsion-forming surfactants used in cleaning compositions. Such suitable emulsifiers include, but are not limited to, alkyl ether sulfates (e.g., RHODAPEX EA-2, Rhodia), alkyl sulfates (e.g., TEA lauryl sulfate), EO/PO block copolymer surfactants with an HLB greater than 12 (e.g., PLURONIC L64, commercially available from BASF, Mount Olive, N.J.), aliphatic phosphate ester (e.g., LUBROPHOS LM 400, commercially available from Rhodia), alkanol amides (e.g., ALKAMIDE C-212, commercially available from Rhodia), imadazoline surfactants (e.g., MIRAMINE OC, commercially available from Rhodia), and amine oxides (e.g., MACKAMINE C-10 DECYLAMINE OXIDE, commercially available from McIntyre, University Park, Ill.). Cationic surfactants, however, cannot be used in the present aqueous cleaner composition because they would make the solid substrate surface hydrophobic (with hydrophobic tails sticking up from the surface), thereby defeating the purpose of the superwetting agents in the present aqueous cleaner composition. When the emulsifier is included in the present aqueous cleaner composition, it is preferably present in the range of about 0.5 to 1.0% by weight of the aqueous composition.

Beside emulsifiers as an optional component in the aqueous cleaner composition according to the present invention, chelating agents, such as an amine or ammonium salt of ethylene diamine tetraacetic acid, to address the removal of hard water stains and deposits, a volatile odor agent, i.e., fragrance, and a biocide can be added. Generally, fragrances are present in the range of about 0.006 to 0.1% by weight, and biocides are present in the range of about 0.05 to 0.5% by weight in the aqueous cleaner composition. The water used in the present aqueous cleaner composition preferably has negligible amounts of metal ions and minerals, with distilled water or deionized water being preferred.

The pH of the aqueous cleaner composition according to the present invention, which can be adjusted as necessary, such as with organic acids or organic amines, is preferably in the range of about 4 to 9. More preferably, the pH is in the range of about 4.5 to 6, particularly when amines are present so as to prevent the amines from becoming volatile and generating an objectional odor. When ionic surfactants are used in the present aqueous cleaner composition, the positive ion is preferably ammonia or an amine.

It was found by the present inventors that neutralization of amine surfactants or hydroxylated amines in the present aqueous cleaner composition with organic acids formed an organic ionic salt, which further enhanced the cleaning properties of the aqueous cleaner composition by facilitating the lifting or flaking of the soil from the substrate surface. The organic salt thus formed moves to the soil/substrate interface 30 (FIG. 1) where the organic salt makes the surface at the soil/substrate interface hydrophilic, which then repels hydrophobic soils. Such an organic salt spreads under the soil deposit at the soil/substrate interface to lift or flake off the soil, thereby enhancing the cleaning properties of the present aqueous cleaner composition. The presence of hydroxylated amines and/or organic acids in the aqueous cleaner composition according to the present invention can, thus, serve the dual purpose of pH adjustment and formation of an organic salt that lifts or flakes off soil deposits from substrate surfaces. Non-limiting examples of suitable organic amines, which include hydroxylated amines, are mon/di/triethanolamine, mono/di/tri isopropanolamine, ethylene diamine tetraethoxylate, and ethylene diamine tetrahydroxide. Suitable organic acids for neutralizing amine surfactants and hydroxylated amines include, but are not limited to, ethylene diamine tetraacetic acid (which also functions as a chelating agent), citric acid, glycolic acid, and acetic acid.

A preferred embodiment for an aqueous glass and appliance cleaning composition is presented below in Table 1.

TABLE 1

| Component | Weight Percentage | Function |
|---|---|---|
| DYNOL 604 Surfactant | 0.032 | Substrate Wetting |
| SURFADONE LP-100 | 0.04 | Surface tension reduction |
| ARCO N-Methyl Pyrrolidone | 0.5 | Degreasing |
| ARCO Dipropylene glycol methyl ether | 0.5 | Household soil coupling agent |
| ARCO Propylene glycol n-propyl ether | 0.5 | Industrial soil coupling agent |

For general purpose cleaning, a preferred embodiment is present below in Table 2.

TABLE 2

| Component | Weight Percentage | Function |
|---|---|---|
| Dow Corning Q2-5211 | 0.03 | Substrate Wetting |
| SURFADONE LP-100 | 0.04 | Surface tension reduction |
| ARCO N-Methyl Pyrrolidone | 0.5 | Degreasing |
| ARCO Dipropylene glycol methyl ether | 0.5 | Household soil coupling agent |
| ARCO Propylene glycol n-propyl ether | 0.5 | Industrial soil coupling agent |
| ARCO PM Acetate | 1.0 | Coupling |

For disinfectant cleaning, a preferred embodiment is presented below in Table 3.

TABLE 3

| Component | Weight Percentage | Function |
|---|---|---|
| Dow Corning Q2-5211 | 0.03 | Substrate Wetting |
| SURFADONE LP-100 | 0.04 | Surface tension reduction |
| ARCO N-Methyl Pyrrolidone | 1.0 | Degreasing |
| ARCO Dipropylene glycol methyl ether | 0.5 | Household soil coupling agent |
| ARCO Propylene glycol n-propyl ether | 0.5 | Industrial soil coupling agent |
| RHODAPEX CD-128 | 0.5 | Emulsifier |
| T-2 Laboratories ALPHAPURE | 0.02 | Biocide |

A preferred embodiment for heavily soiled surfaces is presented below in Table 4.

TABLE 4

| Component | Weight Percentage | Function |
|---|---|---|
| Dow Corning Q2-5211 | 0.03 | Substrate Wetting |
| SURFADONE LP-100 | 0.04 | Surface tension reduction |
| ARCO N-Methyl Pyrrolidone | 2.0 | Degreasing |
| ARCO Dipropylene glycol methyl ether | 0.5 | Household soil coupling agent |
| ARCO Propylene glycol n-propyl ether | 0.5 | Industrial soil coupling agent |
| Amine Glycol Ether | 0.03 | Substrate wetting |
| Di (monoethanolamine) Cocoampho Dipropionate | 1.0 | Emulsifier |
| Versene EDTA Acid | to pH 4.5 | pH adjustment, chelant |

Another preferred embodiment for heavily soiled surfaces is presented below in Table 5.

TABLE 5

| Component | Weight Percentage | Function |
|---|---|---|
| Amine Glycol Ether | 0.03 | Substrate wetting |
| SURFADONE LP-100 | 0.04 | Surface tension reduction |
| ARCO N-Methyl Pyrrolidone | 2.0 | Degreasing |
| ARCO Dipropylene glycol methyl ether | 0.5 | Household soil coupling agent |
| ARCO Propylene glycol n-propyl ether | 0.5 | Industrial soil coupling agent |
| Acetic Acid | to pH 4.5 | pH adjustment |

The household soil coupling agent and the industrial soil coupling agent indicated above in Tables 1–5 are intended to distinguish between "household" soils, such as fatty acids, cooking grease and the like, and "industrial" soils, such as motor oil, benzene and the like.

The aqueous hard surface cleaner composition according to the present invention contains only small quantities of surfactants and no metal ions. The components can be selected to have a sufficiently high vapor pressure that the residual after evaporation will not leave visible deposits. Thus, compositions can be made from components that are completely volatile. However, if silicone surfactants are used in the present aqueous cleaner composition, then the residual after evaporation will leave a shine on the cleaned surface.

To show the synergistic effect, the preferred embodiment for cleaning glass and appliances as presented in Table 1 and the components therein, either individually or in combinations, were tested for spreading relative to water, for surface tension and for soil removal in the examples below.

EXAMPLE 1

Comparative Test of Spreading Relative to Water

The spreading area relative to water was measured by pipetting 0.5 ml of sample onto a glazed ceramic tile. The drop was allowed to spread until the edge of the drop stopped moving. The diameter of the drop was measured four times, including the smallest and largest diameters. These measurements were then averaged, and the area of the drop calculated. The spreading areas were then normalized to the spreading area of deionized water (Table 6).

TABLE 6

Comparative Test of Spreading Area Relative to Water

| Sample Composition | Spread Area Relative to Water |
|---|---|
| 0.1% DYNOL 604 | 1.86 |
| 0.1% N-octyl pyrrolidone (NOP) | 1.35 |
| 1.5% Dipropylene glycol methyl ether (DPM) | 0.957 |
| 0.1% DYNOL 604, 1.5% DPM, Propylene Glycol n-Propyl Ether (PnP) | 1.92 |
| 0.1% NOP, 1.5% DPM, 1.5% PnP | 1.32 |
| 0.1% DYNOL 604, 0.1% NOP | 2.07 |
| Preferred Embodiment Presented in Table 1 | 2.08 |

EXAMPLE 2

Comparative Test of Surface Tension

The same compositions listed in Table 6 were tested for surface tension. The surface tension of the samples were determined using a Fisher Tensiomat #21. These results are summarized in Table 7.

TABLE 7

Comparative Test of Surface Tension

| Sample Composition | Surface Tension (dyne/cm) |
|---|---|
| 0.1% DYNOL 604 | 28.8 |
| 0.1% N-octyl pyrrolidone (NOP) | 32.1 |
| 1.5% Dipropylene glycol methyl ether (DPM) | 63.4 |
| 0.1% DYNOL 604, 1.5% DPM, Propylene Glycol n-Propyl Ether (PnP) | 29.4 |
| 0.1% NOP, 1.5% DPM, 1.5% PnP | 33.4 |
| 0.1% DYNOL 604, 0.1% NOP | 29.4 |
| Preferred Embodiment presented in Table 1 | 29.5 |

EXAMPLE 3

Comparative Test of Soil Removal

The compositions tested in Examples 1 and 2 were further tested for soil removal according to a Glass Cleaner Efficacy Test as modified from the standardized test, CSMA Designation DCC-09 disclosed in CSMA Detergents Division Test Methods Compendium, 3rd. Edition, Chemical Specialties Manufacturers Association, Washington, D.C. (1995). The designation protocol was modified due to the presence of some harmful solvents in the delivery vehicles used for the soil, in particular, perchloroethylene. The test procedure as modified is as follows:

Mirrored tiles were sprayed with a mixture of 0.5% (wt) Spangler's Sebrum Soil and 0.5% (wt) mineral oil suspended in isopropyl alcohol. The soil suspension was allowed to dry on the tile for at least 30 minutes, so that the isopropyl alcohol delivery vehicle evaporated. The residue left behind is the soil needed for testing.

Two ml of the sample glass cleaning solution was spread on the soiled tiles. The tiles were divided into two sides by obscuring one side during spraying. The sample solution was allowed to sit for 30 seconds and then wiped. Wiping was performed by wrapping a paper towel around a rigid sponge, with the wrapped sponge being pulled along the length of the tile with constant pressure. The sponge was turned to another edge, and the wiping repeated four times, each with constant pressure strokes. The residual soil was then rated according to the protocol given in CSMA Designation DCC-09.

Four tests were performed, and the four ratings for each composition were averaged. Table 8 shows the results of these tests.

TABLE 8

Soil Removal Test Results Derived from a Modified CSMA Glass Cleaner Test

| Sample Composition | Soil Removal | % Total Actives |
|---|---|---|
| 0.1% DYNOL 604 | 2.00 | 0.1 |
| 0.1% N-octyl pyrrolidone (NOP) | 1.67 | 0.1 |
| 1.5% Dipropylene glycol methyl ether (DPM) | 1.33 | 1.5 |
| 0.1% DYNOL 604, 1.5% DPM, 1.5% Propylene Glycol n-Propyl Ether (PnP), 0.5% NMP | 1.67 | 3.6 |

TABLE 8-continued

Soil Removal Test Results Derived from a Modified CSMA Glass Cleaner Test

| Sample Composition | Soil Removal | % Total Actives |
|---|---|---|
| 0.1% NOP, 1.5% DPM, 1.5% PnP, 0.5% NMP | 2.67 | 3.6 |
| 0.1% DYNOL 604, 0.1% NOP | 2 | 0.2 |
| Preferred Embodiment Presented in Table 1 | 3 | 1.6 |

The results of the tests shown in Examples 1–3 show that the air/water and water/substrate interface surfactants give extremely low values of surface tension and spreading area relative to water, as would be expected. However, synergy between these two surfactants was observed, as evidenced by the spreading and surface tension values given for the preferred embodiment in Table 7. This preferred embodiment uses only 0.032% by weight of DYNOL 604 and 0.04% of N-(n-octyl) pyrrolidone, compared to 0.1% used in the component tests. The addition of a coupling agent for soil removal adds to the cleaning synergy. The rating of soil removal was the highest for the synergistic embodiment presented in Table 1. Even when used at greater concentrations, the coupling agents by themselves as single components did not perform as well as the preferred embodiment of Table 1.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. The aqueous hard surface cleaner composition, consisting essentially of:

about 0.02 to 0.2% by weight of a surface tension reducing agent selected from the group consisting of linear aliphatic pyrrolidone surfactants, acetylenic diols, fluorinated surfactants, low HLB silicones, and mixtures thereof;

about 0.01 to 0.1% by weight of a superwetting agent selected from the group consisting of di- or tri-siloxane glycol ethers, amine glycol ethers of the formula $H_2N—(CH_2)_x—(OCH_2CH_2)_y—OH$, where x=2–4 and y=4–10, low volatile organic content acetylenic diols, di- or tri-siloxane glycerol polymers with a glycerol based hydrophilic head, amine glycerol polymers with a glycerol based hydrophilic head, and mixtures thereof;

about 0.75 to 3% by weight of an organic agent which is a mixture of dipropylene glycol methyl ether, N-methyl pyrrolidone and propylene glycol n-propyl ether in equal proportion;

water, wherein the pH of the aqueous composition is in a range of about 4 to 9;

optionally, about 0.5 to 1.0% by weight of an emulsifier;

optionally, a chelating agent;

optionally, an organic acid and/or an organic amine to adjust the pH of the aqueous composition to said pH range; and optionally, a biocide.

2. The aqueous hard surface cleaner composition according to claim 1, wherein said mixture of said organic coupling or degreasing agents is present at about 0.75% by weight in the aqueous composition.

3. The aqueous hard surface cleaner composition according to claim 1, wherein said organic coupling or degreasing agent is present in a range of about 0.75 to 3% by weight.

4. An aqueous hard surface cleaner composition, consisting essentially of:

about 0.04% by weight of a linear aliphatic pyrrolidone surfactant as a surface tension reducing agent;

about 0.03% by weight of an acetylenic dial having a low volatile organic content of less than 5% as a superwetting agent;

an organic agent which is a mixture of about 0.5% by weight N-methyl pyrrolidone, about 0.5% by weight dipropylene glycol methyl ether, and about 0.5% by weight propylene glycol n-propyl ether;

water, wherein the pH of the aqueous composition is in a range of about 4 to 9;

optionally, about 0.5 to 1.0% by weight of an emulsifier;

optionally, a chelating agent;

optionally, an organic acid and/or an organic amine to adjust the pH of the aqueous composition to said pH range; and optionally, a biocide.

5. An aqueous hard surface cleaner composition, consisting essentially of:

about 0.04% by weight of a linear aliphatic pyrrolidone surfactant as a surface tension reducing agent;

about 0.03% by weight of a di/tri-siloxane glycol ether as a superwetting agent;

an organic agent which is a mixture of about 0.5% by weight N-methyl pyrrolidone, about 0.5% dipropylene glycol methyl ether, about 0.5% propylene glycol n-propyl ether, and about 1.0% by weight of an acetate solvent;

water, wherein the pH of the aqueous composition is in a range of about 4 to 9;

optionally, about 0.5 to 1.0% by weight of an emulsifier;

optionally, a chelating agent;

optionally, an organic acid and/or an organic amine to adjust the pH of the aqueous composition to said pH range; and optionally, a biocide.

6. An aqueous hard surface cleaner composition, consisting essentially of:

about 0.04% by weight of a linear aliphatic pyrrolidone surfactant as a surface tension reducing agent;

about 0.03% by weight of a di/tri-siloxane glycol ether as a superwetting agent;

an organic agent which is a mixture of about 1.0% by weight of N-methyl pyrrolidone, about 0.5% by weight dipropylene glycol methyl ether, and about 0.5% by weight of propylene glycol n-propyl ether;

water, wherein the pH of the aqueous composition is in a range of about 4 to 9;

about 0.5% by weight of an emulsifier;

about 0.02% by weight of a biocide;

optionally, a chelating agent;

optionally, an organic acid and/or an organic amine to adjust the pH of the aqueous composition to said pH range.

7. The aqueous hard surface cleaner composition, consisting essentially of:

about 0.04% by weight of a linear aliphatic pyrrolidone surfactant as a surface tension reducing agent;

about 0.03% by weight of a di/tri-siloxane glycol ether and about 0.03% of an amine glycol ether as a superwetting agent;

an organic agent which is a mixture of about 2.0% by weight N-methyl pyrrolidone, about 0.5% by weight of dipropylene glycol methyl ether, and about 0.5% by weight of propylene glycol n-propyl ether;

water;

about 1.0% by weight of di(monoethanolamine) cocoampho dipropionate as an emulsifier;

EDTA as an organic acid in an amount sufficient to adjust the pH of the aqueous composition to about 4.5;

optionally, a chelating agent; and optionally, a biocide.

8. The aqueous hard surface cleaner composition, consisting essentially of:

about 0.04% by weight of a linear aliphatic pyrrolidone surfactant as a surface tension reducing agent;

about 0.03% by weight of an amine glycol ether as a superwetting agent;

an organic agent which is a mixture of about 2.0% by weight N-methyl pyrrolidone, about 0.5% by weight of dipropylene glycol methyl ether, and about 0.5% by weight of propylene glycol n-propyl ether;

water;

acetic acid present in an amount sufficient for adjusting the pH of the aqueous composition to about 4.5;

optionally, about 0.5 to 1.0% by weight of an emulsifier;

optionally, a chelating agent; and optionally, a biocide.

* * * * *